US005701788A

United States Patent [19]

Wilson et al.

[11] Patent Number: 5,701,788

[45] Date of Patent: Dec. 30, 1997

[54] RAZOR BLADE MANUFACTURE

[75] Inventors: Robert Wilson, Attleboro, Mass.; Laurence Robert Beesley, Essex, England; Robert H. Flanagan, Watertown, Mass.

[73] Assignee: The Gillette Company, Boston, Mass.

[21] Appl. No.: 559,796

[22] Filed: Nov. 15, 1995

[51] Int. Cl.[6] ..... B21K 11/00

[52] U.S. Cl. ..... 76/104.1; 76/DIG. 8; 83/423

[58] Field of Search ..... 76/104.1, 101.1, 76/116, DIG. 8; 83/423, 685; 72/337

[56] References Cited

U.S. PATENT DOCUMENTS 1,370,381 3/1921 Tarbox ..... 76/DIG. 8

3,780,921 12/1973 Harp ..... 83/423

4,574,563 3/1986 Shimizu ..... 83/423

5,458,025 10/1995 Neamtu ..... 76/104.1

*Primary Examiner*—Hwei-Siu Payer

*Attorney, Agent, or Firm*—Owen J. Meegan; Aubrey C. Brine; Edward S. Podszus

[57] ABSTRACT

A razor blade construction is manufactured of a thin element of blade stock forming the cutting edge portion which is welded or otherwise attached to a more rigid support member. A plurality of support members are produced from a coil of flat sheet material by a cutting and forming process, each of the supports being retained at its edge to an adjacent support to provide a coil of blade supports. The coil of supports is then fed into a device for severing each support from the coil and registering it with a blade element for attachment thereto.

9 Claims, 13 Drawing Sheets

RAZOR BLADE MANUFACTURE

BACKGROUND OF THE INVENTION

The present invention relates to razor blade manufacture and more particularly to a process for the manufacture of a razor blade member comprising a thin element of blade stock welded or otherwise attached to a support member.

In the blade disclosed in U.S. Pat. No. 4,586,255 to Jacobson and assigned to the assignee of the present invention a razor blade is disclosed which employs a cutting edge portion attached, by welding or other means, to a base portion. The cutting portion is generally manufactured of a sheet of blade stock while the base portion is constructed of a design to provide rigidity to the cutting edge portion as well as an extension which may be included in the razor blade assembly.

In the current production of an assembled razor blade structure as set forth above, the blade supports are generally formed and separated one from the other. The supports are then transported, as loose pieces in bulk, from the stamping process to an assembly point where they are assembled to the blade cutting edge portion. The known process limits the speed of assembly as well as machine efficiency. Further, at the point of assembly the loose razor blade supports are generally placed into a vibratory feeder hopper, which is effective to align the blade supports onto a feed belt over which they are transported to a station for alignment with the cutting edge portion, and subsequent fastening to the cutting edge portion occurs. While the feeding process employing a vibratory feed device is well known in the art and effective in achieving the deposition of the blade support at the required station of operation, the bulk transfer and subsequent feeding processes tend to result in a number of items which must be scrapped during the feeding process, or which are subsequently unable to pass inspection due to bending or other damage during the transporting and feeding process.

With the foregoing in mind, the present invention has as an object to provide a method of manufacturing razor blade structure comprising a thin element of blade stock which forms the cutting edge portion, and a support member to which it is attached wherein the support members are formed and provided at the location of attachment to the cutting edge portion of the blade, with a minimum of scrap produced by transfer of the support members to the point of attachment.

Another object of the invention is to provide a razor blade manufacturing process of the type set forth above wherein the rejection rate of razor blades due to damage to blade supports is minimized.

Yet another object of the invention is to provide a razor blade manufacturing process of the type set forth above wherein processing machine time is employed more efficiently and there is an increase in machine up time.

SUMMARY OF THE INVENTION

The above objects and other objectives which will become apparent as the description proceeds are achieved by providing a method of manufacturing a plurality of razor blades each having a cutting edge portion affixed to an elongated support member by first providing an elongated strip of sheet material having opposite edge portions which is in the coiled condition. A plurality of discrete support members are formed between the opposite edge portions at a first work station and the coil is rewound with the support members retained between the elongated strip edge portions. The coil is then introduced to a second work station having means for feeding the strip of material into the work station and the strip of material is fed along a path into the second work station. At the second work station each support member is severed sequentially from between the opposite edge portions and removed from the second work station in a direction transverse to the path of feeding of the strip material to a third station for attachment to a cutting edge portion of a razor blade.

The method may also include the step of a forming a plurality of registration openings in the opposite edges of the strip of sheet material during the forming of the support members and the means for feeding the strip into the second work station may comprise a sprocket for engaging the registration openings and thereby feeding the strip of material.

The method may also include the step of aligning the strip of material at the second work station prior to severing each of the support members from the strip. When a plurality of registration openings are formed at opposite edges of the strip of sheet material alignment may be provided by a plurality of elongated alignment members which extend through the registration openings.

The support members are substantially L-shaped in cross-section and a strip of barrier material may be provided to one surface of the strip of sheet material after forming the plurality of discrete support members and prior to rewinding of the coil after operation at the first work station.

The apparatus for the manufacture of razor blades having a cutting edge portion and elongated support member generally comprises means for feeding an elongated strip of sheet material in roll form along a path into a work station, the work station comprising die means for supporting the strip sheet material solely at opposite edges of the sheet. A punch member is disposed in a first position adjacent one surface of the strip of sheet material for movement through the sheet to a second position to sever a support member from between the sheet opposite edges. Track means are disposed adjacent the work station and means for forcing the severed support members in a direction transverse to the path of feed of the elongated strip is provided for depositing the support member onto the track. The means for feeding the elongated strip into the work station may comprise rotatable sprocket means for registration with opposite edges of the elongated strip of sheet material, and means may further be provided for aligning the strip of material with the punch member the aligning means being disposed prior to the punch member along the path of the strip of sheet material. The elongated strip of sheet material may be provided with a plurality of openings formed adjacent opposite edges thereof and the aligning means comprise a plurality of pins disposed on either side of the strip of sheet material path for extending through the strip of sheet material and maintaining it in alignment.

BRIEF DESCRIPTION OF THE DRAWING

Reference is made to the accompanying drawing in which there is shown an illustrative embodiment of the invention from which its novel features and advantages will be apparent, wherein.

DESCRIPTION OF THE PREFERRED EMBODIMENT

Figure 1:
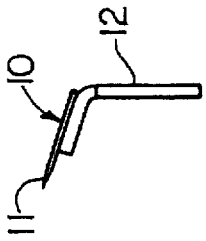
FIG. 1 is an elevational view showing a razor blade structure having a cutting edge portion and a support member constructed in accordance with the teachings of the present invention.
Figure 2:
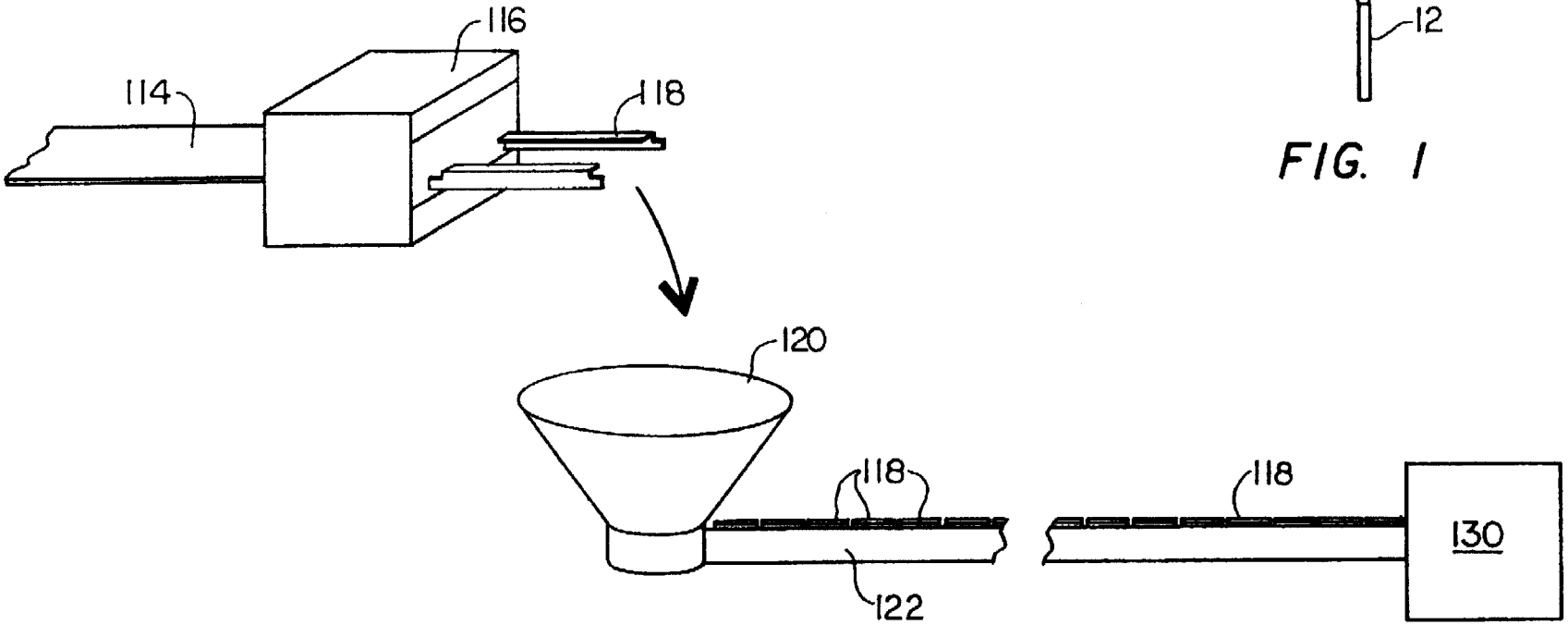
FIG. 2 PRIOR ART
FIG. 2 is a schematic illustration depicting a prior art manufacturing process for producing razor blades as shown in FIG. 1.

Referring now to the drawing and in particular to FIGS. 1 and 2 a razor blade structure 10 is shown which is manufactured of two parts, a cutting edge portion 11 and an L-shaped support member 12, which are welded or otherwise affixed one to the other during the manufacturing process. Razor blades such as the structure 10 are generally employed in those razors which require blades movable relative to the skin surface during the shaving process. As shown in FIG. 2 these blades are generally manufactured by providing an elongated strip 114 of sheet metallic material and running the strip through a work station 116 having a combination die and cutter device to form a plurality of unitary discrete blade support elements 118. The elements 118 are then transported in bulk to the point at which they are to be assembled onto cutting edge portion 11 to form a razor blade structure 10.

At the point of assembly the discrete elements 118 are generally deposited into a vibratory feeder 120, such as is well known in the art, which is effective to align the discrete support members 118 onto a track 122 where they are fed end to end into a work station 130.

The assembly of the cutting edge portion 11 onto the elongated support members 118 (or 12 in the present invention) may be performed at station 130 in a number of processes all of which are well known in the art. Generally a cutting edge portion 11 and a mating elongated support member 118 or 12 are aligned in a, jig, or form, and are moved through a device which performs the fastening process such as welding of the two elements one to the other. The process performed at the station 130 will not be discussed in detail as it is sufficient to indicate herein that the only requirement be that elongated support members 118 be presented in alignment to the station for mating with an appropriate cutting edge portion.

Figure 4:
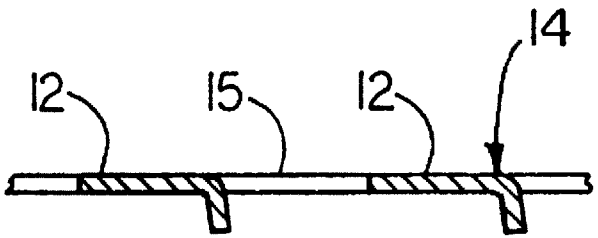
FIG. 4 is a sectional view of a portion of the coil shown in FIG. 3 taken on an enlarged scale for clarity.
Figure 3:
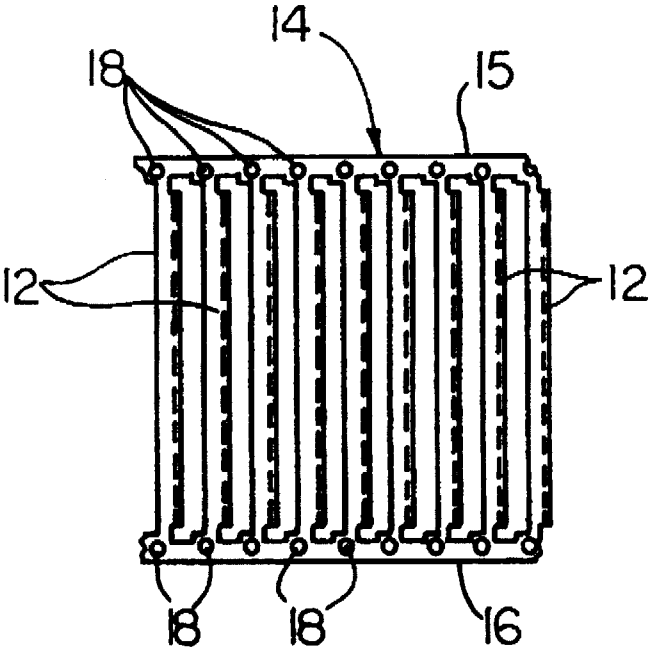
FIG. 3 is a top plan view showing a portion of a coil of support members constructed in accordance with the teachings of the present invention.

Referring now to FIGS. 3 and 4, in the present invention the elongated strip of metallic material 114 is provided in coil form and is fed through a station similar to station 130 having a device for bending and cutting (which may be any device well known in the art) to form a continuous strip 14 having opposite edge portions 15 and 16 with a plurality of L-shaped elongated support members 12 formed therebetween. That is, in the present invention the support members 12 are not severed from the strip but each of the support members 12 being retained at the opposite edge portions 15 and 16. It should further be noted that a plurality of registration openings 18 are formed in each of the edge portions 15 and 16 at spaced intervals, which usage will be explained as the description proceeds.

Figure 5:
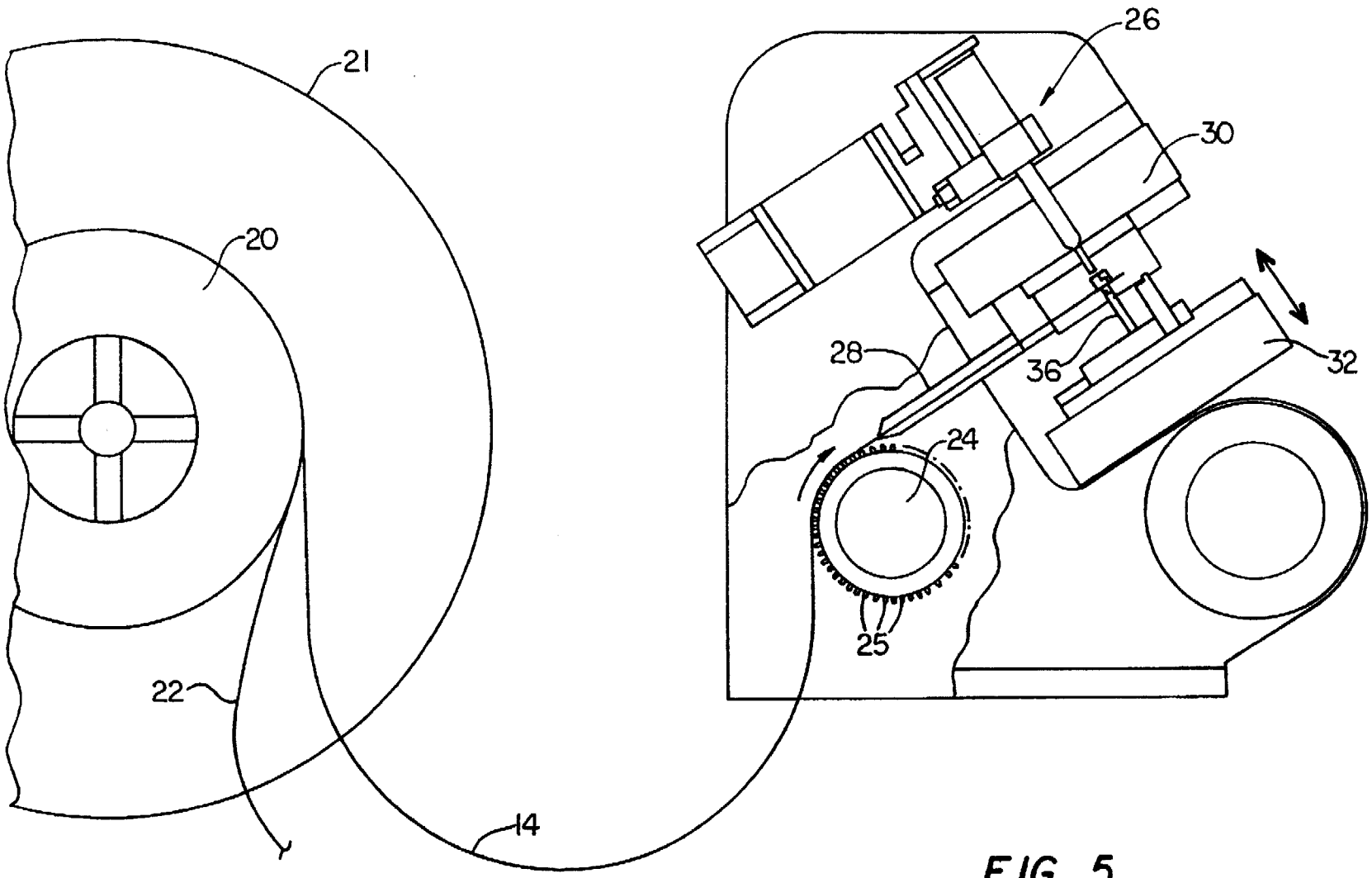
FIG. 5 is an elevational schematic view showing apparatus employed in the manufacturing of razor blades employing the coil of material shown in FIGS. 3 and 4.

The continuous strip 14 is then re-coiled to form a coil 20 placed on a reel 21. As shown in FIG. 5, a strip of barrier material 22 is generally placed on one side of the strip 14 to prevent interlocking, or damage to the free edges of the support members 12 when the coil 20 is formed onto the reel 21.

Figure 6:
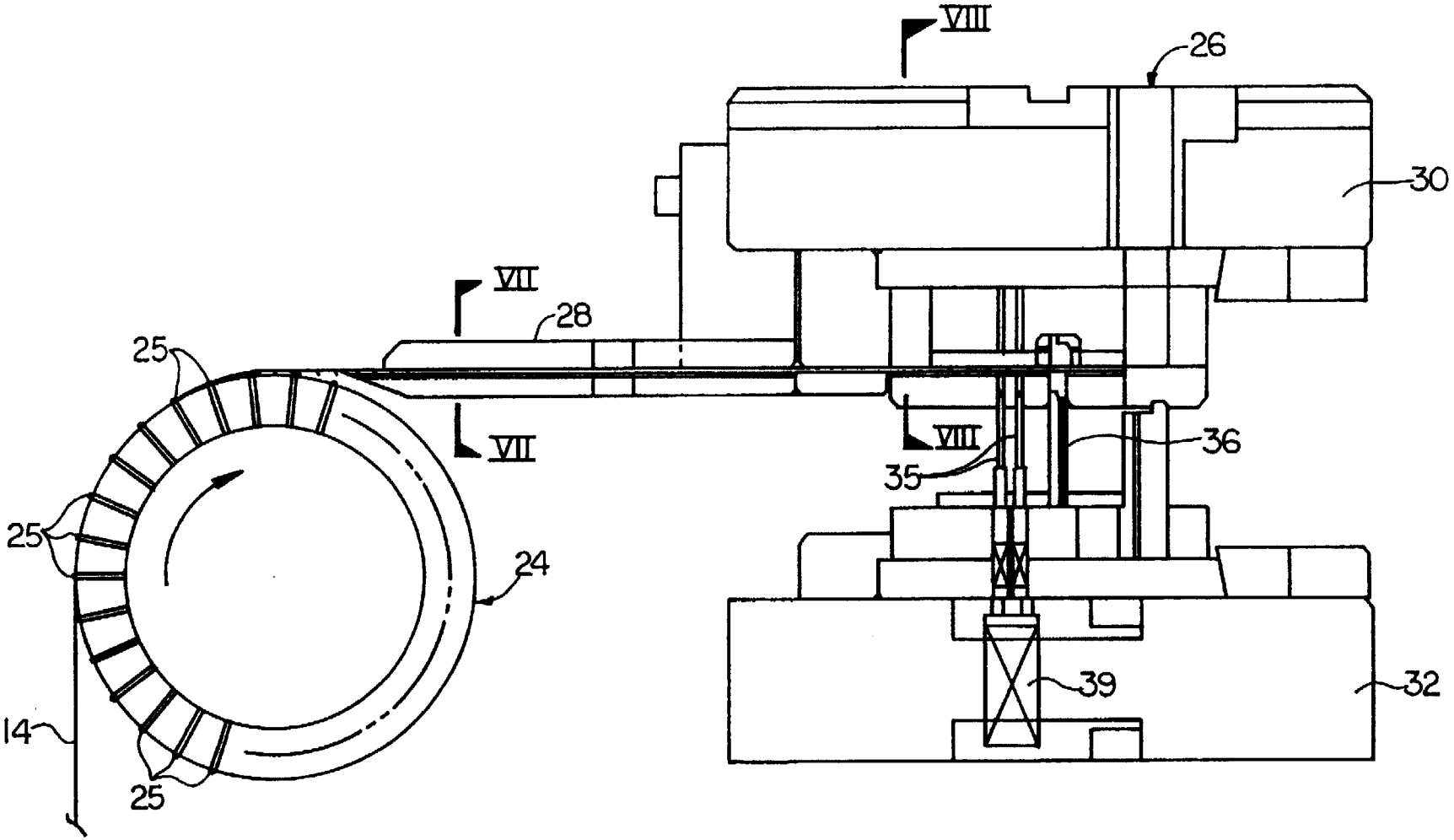
FIG. 6 is an elevational side view showing details of the apparatus of FIG. 5.

Referring now to FIG. 6 taken in conjunction with FIG. 5, the strip 14 is fed from the reel 21 onto a sprocket 24 the sprocket 24 having a plurality of registration pins 25 which are spaced to project through the registration openings 18 and thereby feed the strip 14 into a work station 26, which will be described in detail below.

Figure 7:
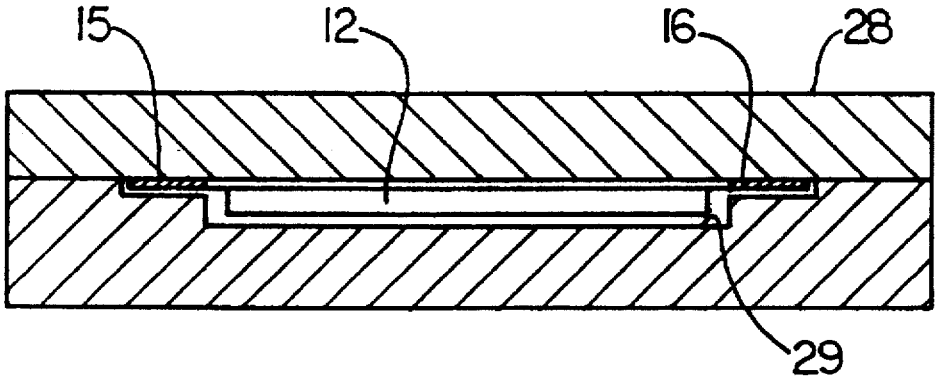
FIG. 7 is an elevational sectional view taken along the line VII—VII of FIG. 6 showing details of the apparatus of FIG. 5 on an enlarged scale.
Figure 8:
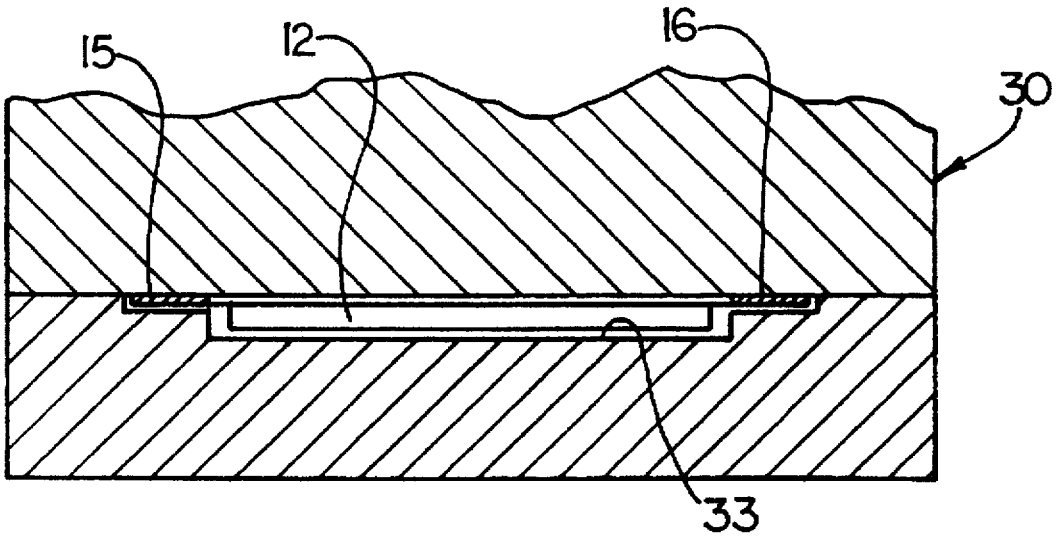
FIG. 8 is an elevational sectional view similar to FIG. 7, taken along the line VIII—VIII of FIG. 6, showing further details of the apparatus of FIG. 6.

Referring to FIG. 7 and 8, the strip 14 is fed by means of the sprocket 24 along a path into a guide member 28 having a slotted opening 29 formed therein for receiving the edge portions 15 and 16 in sliding engagement, and directing the strip into the station 26. The work station 26 further comprises an upper base member 30 and a lower base member 32 for supporting the various working elements of the station 26. As shown in FIG. 8, the upper base member 30 has a slotted opening 33 similar to the opening 29 formed in the guide member 28, the configuration of the opening also being effective to retain the edge portions 15 and 16 therein, for slidable movement of strip 14 of the support members 12 therethrough.

It should be noted here that with regard to the various motors, servo systems, electrical or pneumatic components which may be contained in station 26 to form the operation system 26 that such components are well known in the art, and need not herein be identified in producing the present invention. The system components may be altered from that shown or an alternate component system devised by one familiar with the electrical or pneumatic systems art. The entire operating system will therefore not be explained in detail, though the various elements are depicted as these motors or devices may be changed or exchanged one for the other without departing from the spirit of the present invention.

Figure 11:
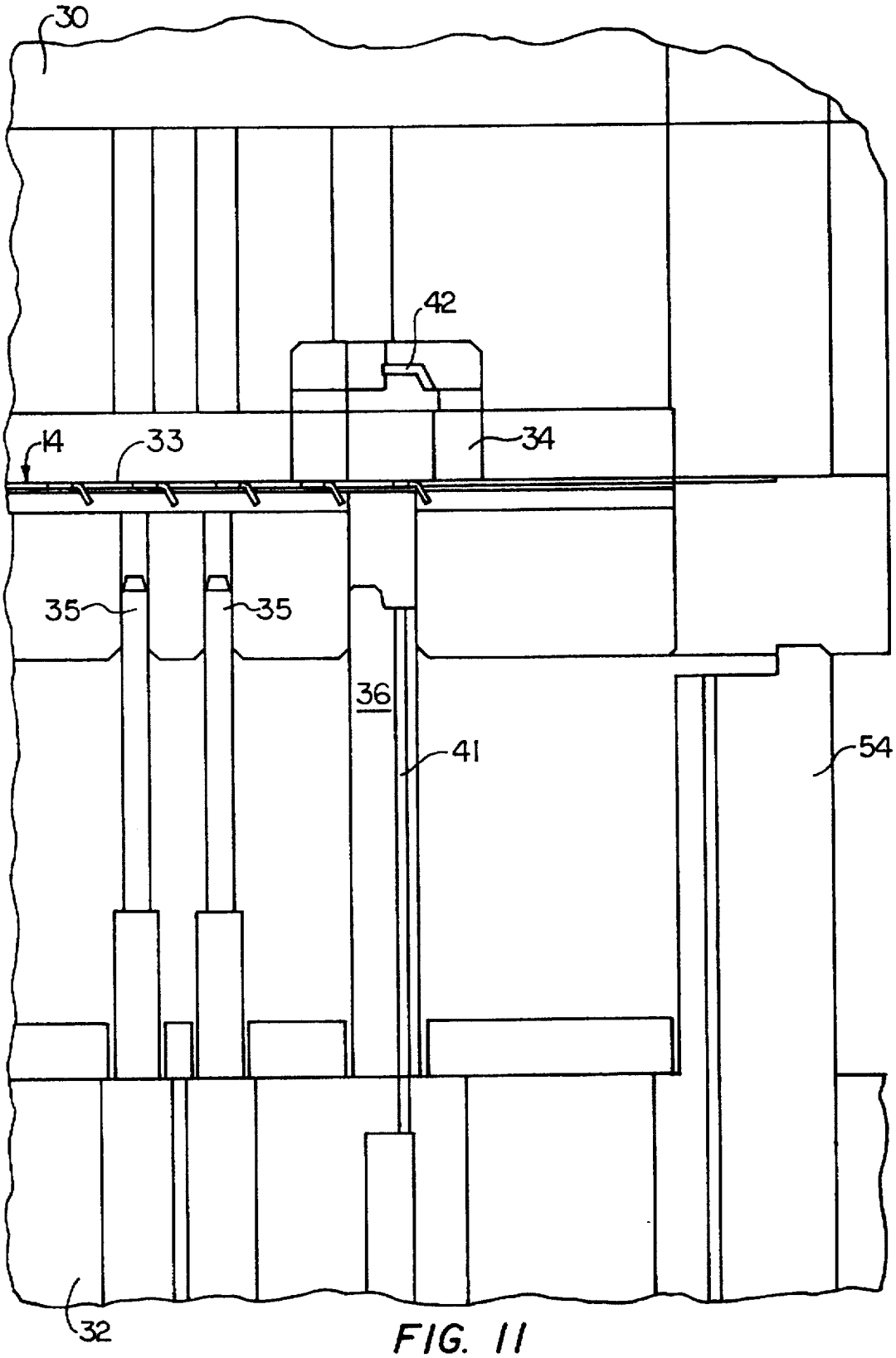
FIG. 11 is a side elevational view showing the apparatus of FIGS. 5 through 9 during a sequence of operation of the apparatus.
Figure 12:
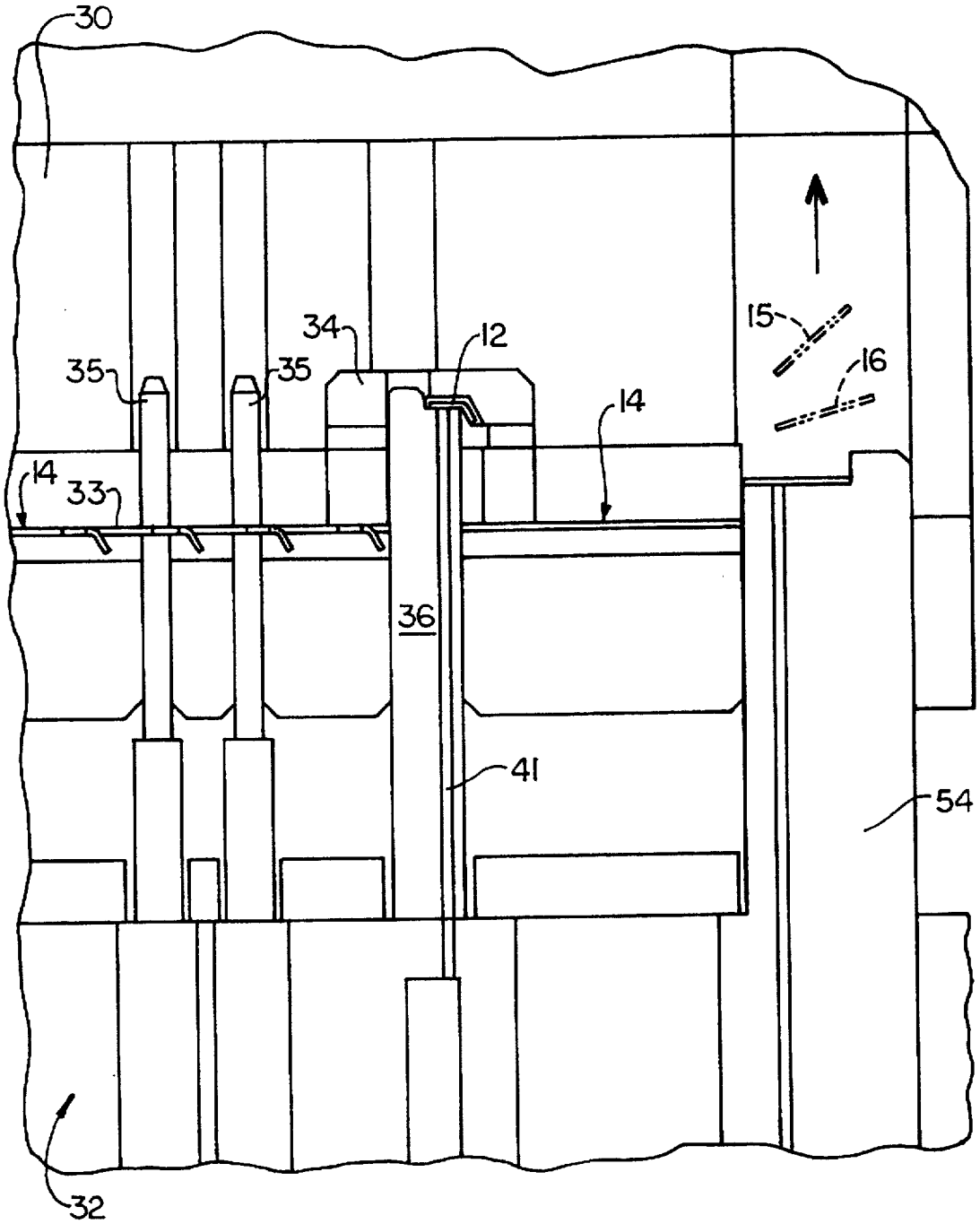
FIG. 12 is a side elevational view similar to FIG. 11 showing the apparatus during another sequence of operation in the process.
Figure 13:
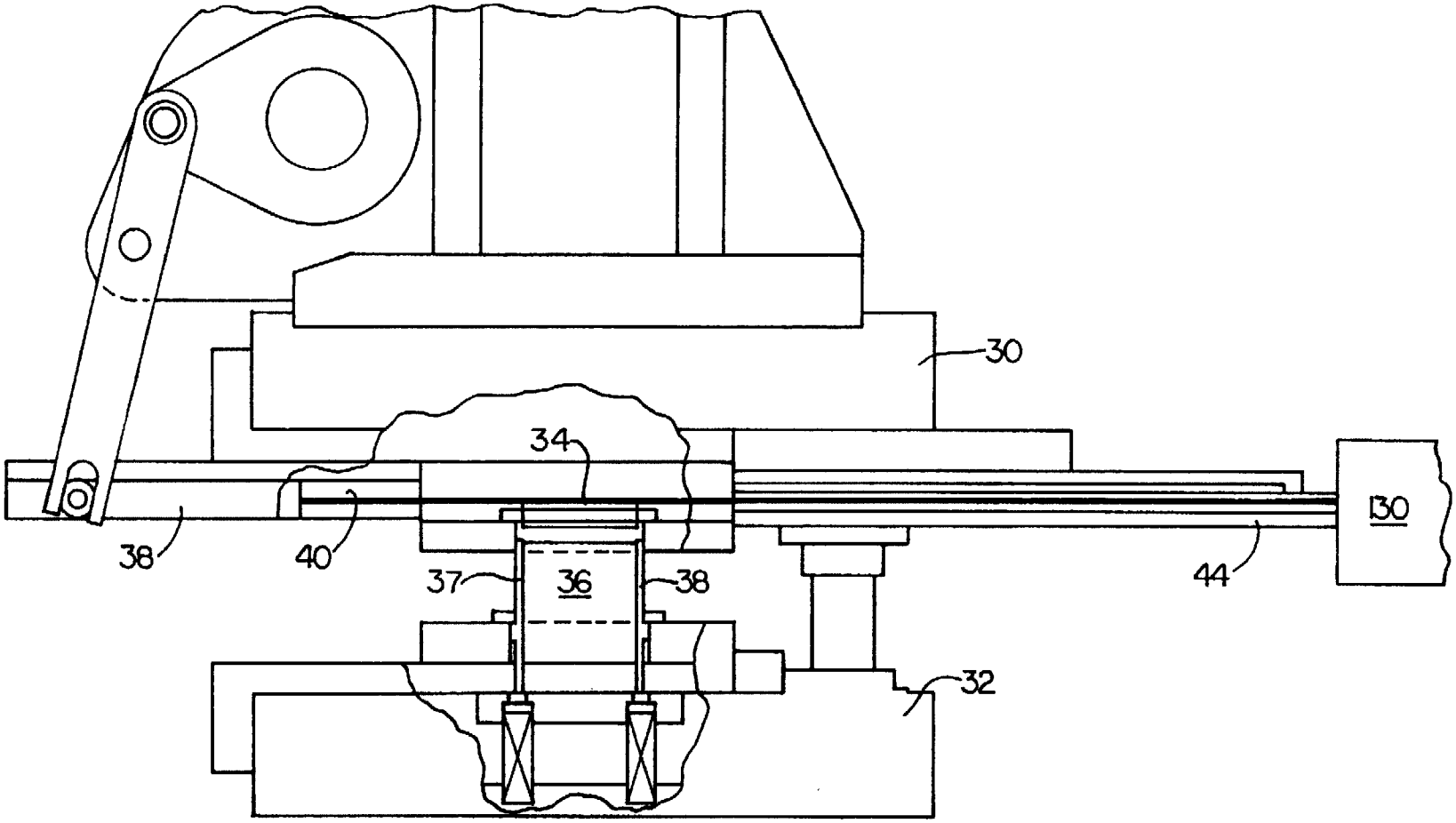
FIG. 13 is a front elevational view of the apparatus of FIGS. 5 through 8 showing further details of the apparatus.

As best shown in FIGS. 12 and 13, aligning means in the form of a plurality of pins 35, four in number, are disposed two on each side of the path of movement of the strip 14. The pins 35 are disposed below the path of the strip 14 and aligned with the registration openings 18 adjacent the edge portions 15 and 16. The pins 35 are spring-mounted (as shown in FIG. 6) and a cylinder 39 is effective to thrust the pins upwardly through the openings 18 during an operation on the strip 14 to maintain the strip in proper position for severing a support member therefrom, as explained below. The pins 35 are then lowered to their initial position as shown in FIG. 11 by cylinder 39.

Figure 15:
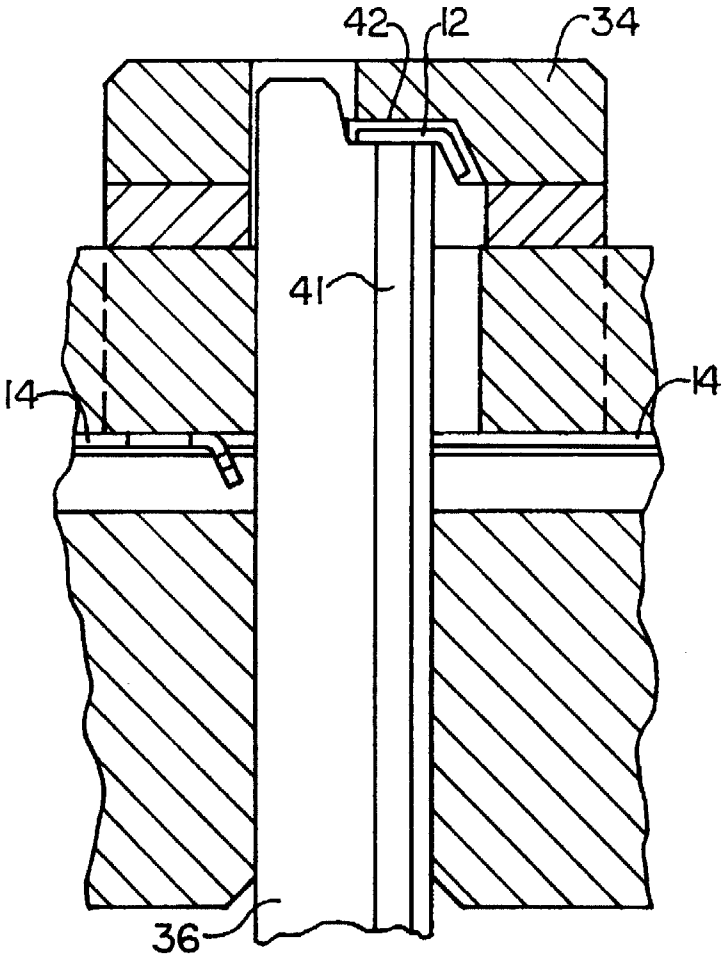
FIG. 15 is an elevational sectional view similar to FIG. 14 showing the apparatus during a further stage of the process.
Figure 14:
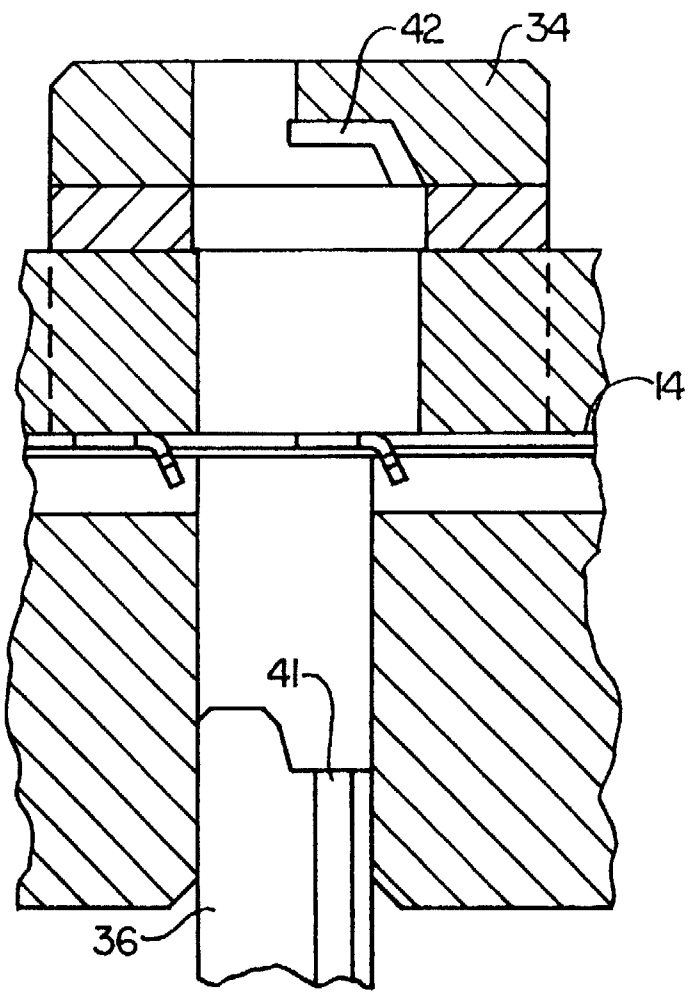
FIG. 14 is an elevational sectional view taken on an enlarged scale along the line XIV—XIV of FIG. 9 showing details of the apparatus during the manufacturing process.

Referring now to drawing FIGS. 11 through 17, as the strip 14 is fed through the station 26, it passes between a stationary die 34 and punch 36 which is movable from the position shown in FIG. 14 to the position shown in FIG. 15. The punch 36 is effective to sever a unitary support member 12 from the strip 14, retain it on the upper surface of the punch and move it to a position shown in FIGS. 15 and 17. It will be noted that a pair of spring clamps 37 and 38 are mounted on either side of the punch 36 the pins being spring-mounted and aligned for contact with the edge portions 15 or 16 and effective to retain the edge adjacent the lower surface of the die member 34 as the punch 36 moves upwardly carrying elongated support member 12.

As may be observed in FIGS. 11 and 12, the punch 36 has an elongated bore 41 formed therein, extending to an opening at the upper surface of the punch. A vacuum is produced in the bore 41 during operation of the punch to maintain a severed support member positioned on the upper surface of the punch 36 until it is removed therefrom.

Figure 9:
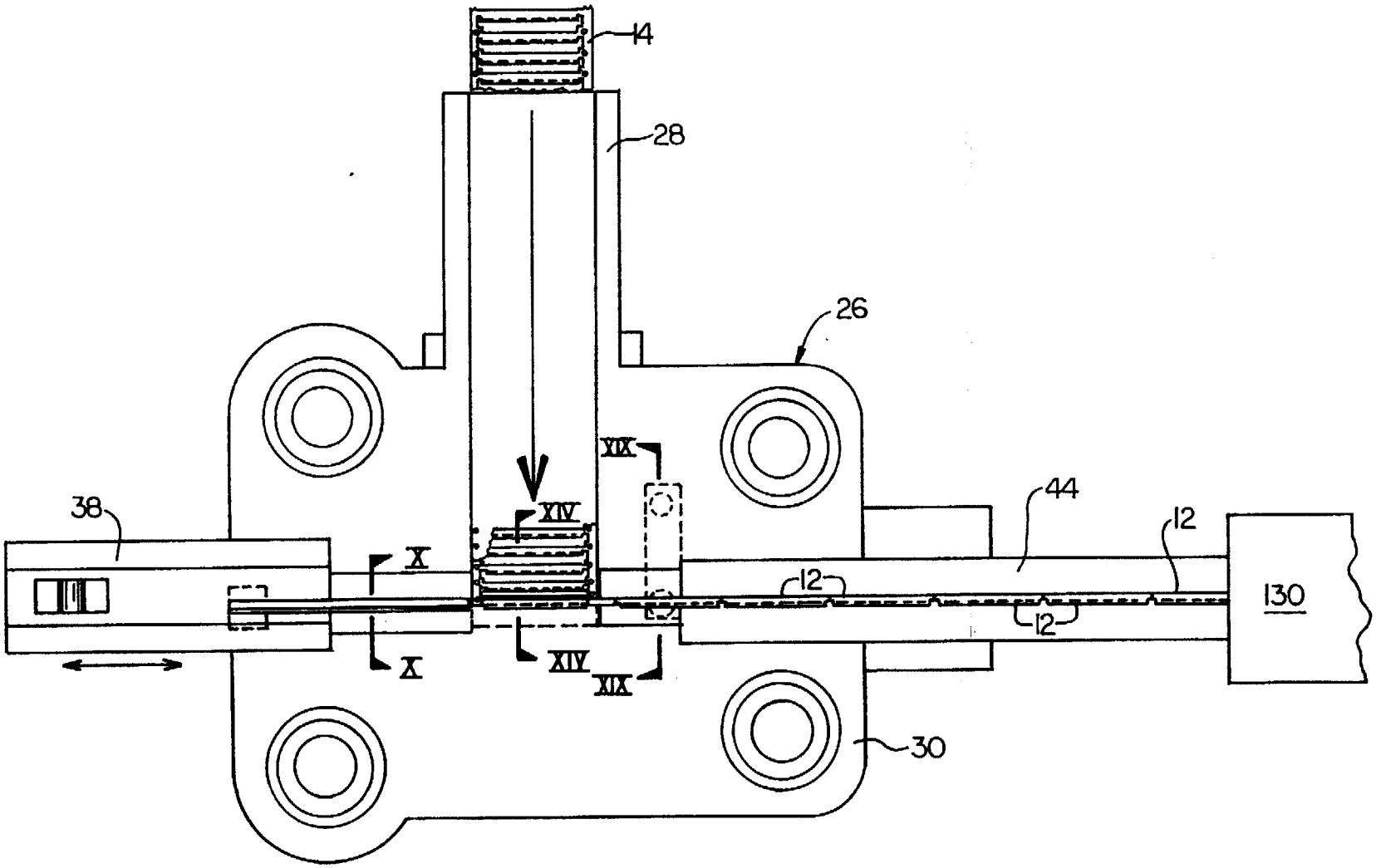
FIG. 9 is a top plan view showing the apparatus of FIG. 5 through 8.

Referring now to FIG. 9 taken in conjunction with FIGS. 11 through 17, a shuttle device 38 is provided with a pusher arm 40 which is disposed adjacent, and in alignment with, a severed elongated support member 12 when supported on the upper surface of the punch 36. Opposite the pusher member 40 an opening 42 is formed in the die member. The opening 42 provides access to a track 44 leading to the work station 130 wherein the elongated support members 12 are joined with a cutting edge portion 11 to form the razor blade structure 10 as shown in FIG. 1.

Figure 19:
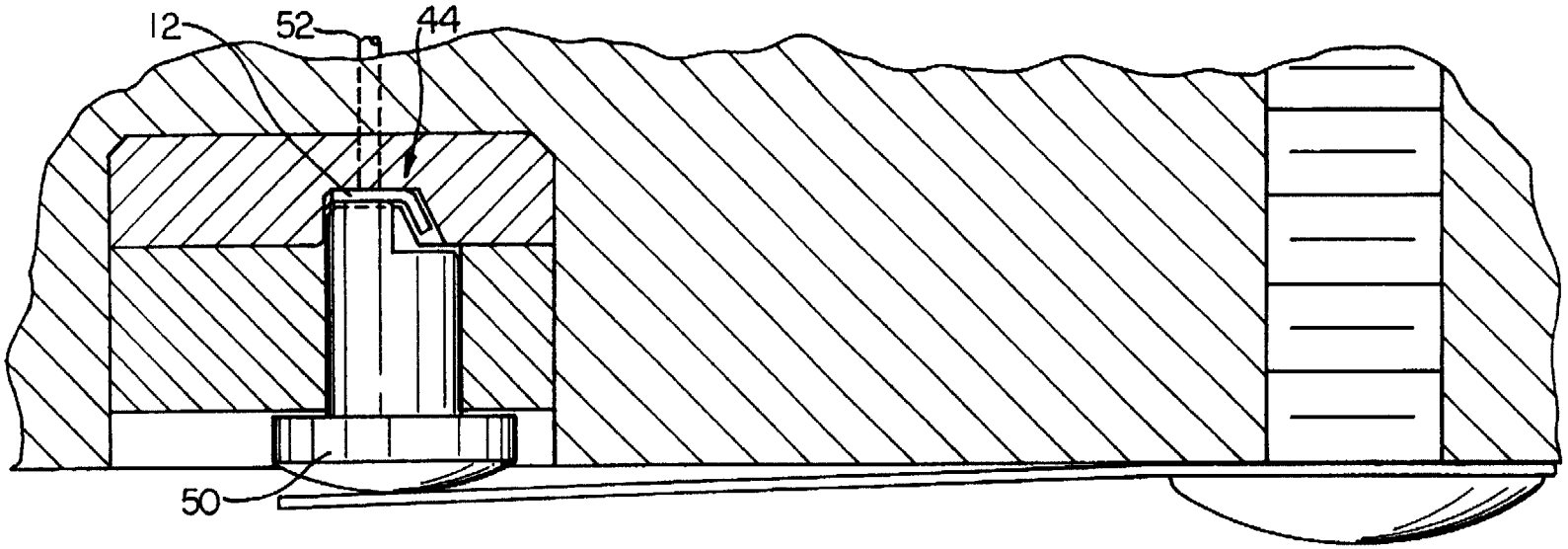
FIG. 19 is an elevational sectional view taken along the line XIX—XIX of FIG. 9 showing details of that portion of the apparatus on an enlarged scale for clarity.
Figure 10:
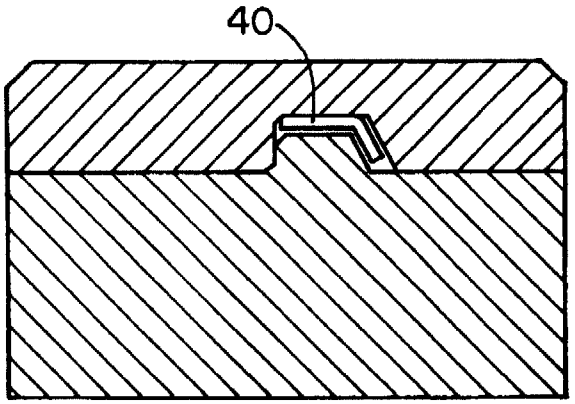
FIG. 10 is an elevational sectional view taken along the line X—X of FIG. 9 showing details of the apparatus on an enlarged scale for clarity.
Figure 16:
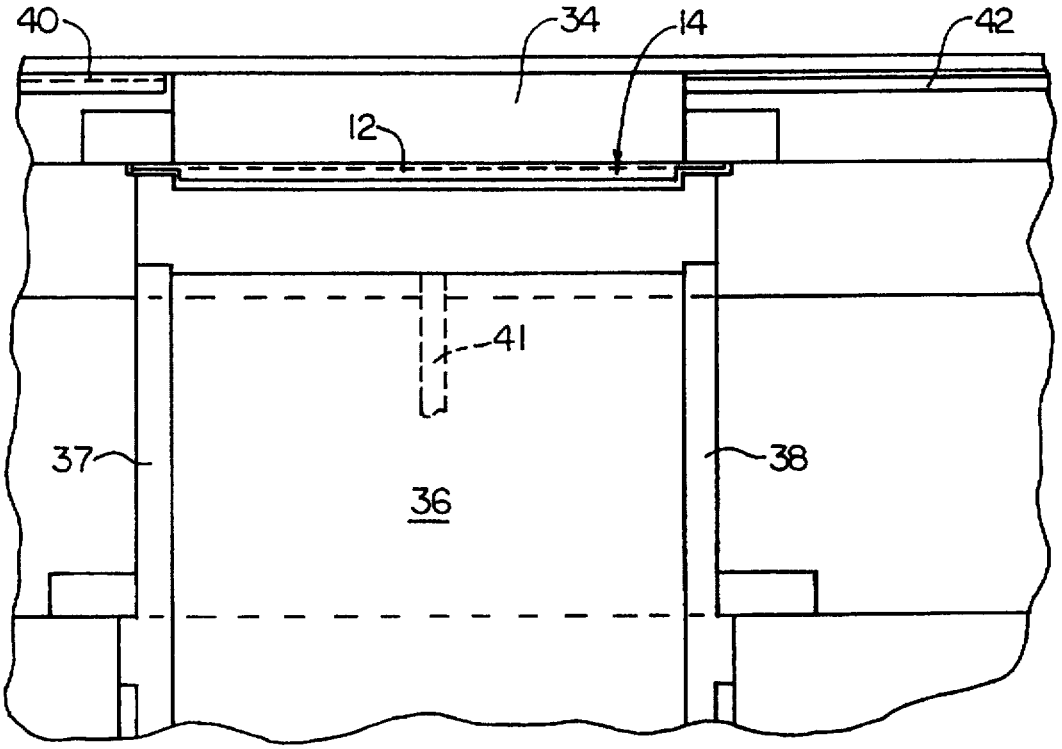
FIGS. 16, 17 and 18 are front elevational views, having portions of the structure eliminated to show the operation of the apparatus shown in FIGS. 14 and 15.
Figure 17:
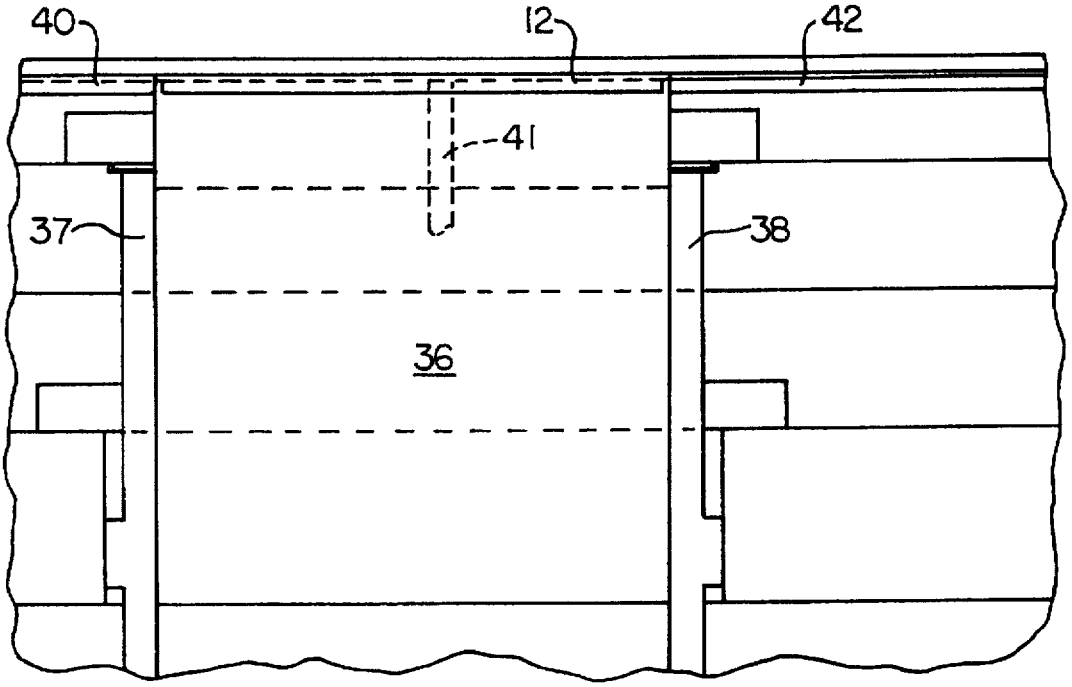
Figure 18:
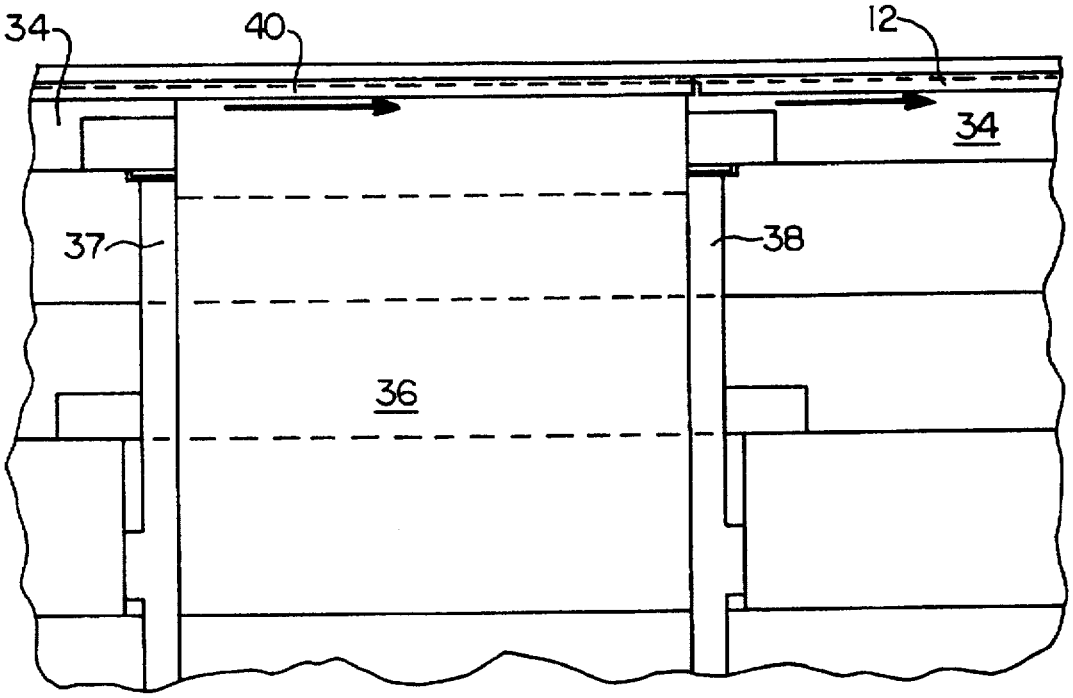

Referring still to FIGS. 16, 17 and 18, with a severed elongated support member 12 supported on the upper surface of the punch 36 in the upward position, as shown in FIGS. 17 and 18 the pusher member 40 is reciprocated across the top of the punch forcing the support member 12 through the opening 42. As shown in FIG. 9, each of the support members 12 is sequentially forced through the opening 42 and between a movable guide 50 which is spring-biased to retain the support member adjacent the upper surface of the track 44. A plurality of vacuum openings 52 (FIG. 19) are provided in the track 44 which serve to retain the support members onto the track as they are pushed by a succeeding support member down the track and into the station 130.

As shown in FIG. 12, after each elongated support member 12 is removed from the strip 14, the edge portions 15 and 16 are forced forwardly along the path of movement of the strip and are sheared by a separate punch 54, the edges 15 and 16 being drawn upwardly by a vacuum, and into a waste bin or other device (not shown) for disposal.

It will be evident from the foregoing that the retention of the plurality of elongated support members 12 in the form of strip 14 during the formation of the support members, and throughout the movement through the station 26 provides an improvement in the manufacture of a razor blade of the type shown. The separate support members are each aligned, retained and controlled during movement of the punching and cutting operation to the formation of the blade structure 10. The retention of the support members 12 in a strip further provides means for movement of the strip 14 through the station 26 by employing only the edge portions 15 and 16. The present invention has therefore resulted in the decrease in waste during the manufacturing operation as well as an increase in the number of parts which may be manufactured during a period of time.

While it is apparent that changes and modifications can be made within the spirit and scope of the present invention, it is our intention, however, only to be limited by the appended claims.

As our invention we claim:

1. A method of manufacturing a plurality of razor blades each having a cutting edge portion affixed to an elongated support member, including the steps of:

providing an elongated strip of sheet material, said elongated strip being in the coiled condition and having opposite edge portions;

forming a plurality of discrete support members between said opposite edge portions at a first work station and rewinding said coiled strip with said support members retained between said opposite edge portions;

introducing said coiled strip at a second work station having means to feed said strip of material into said second work station;

employing said feed means to feed said strip of material along a path into said second work station;

severing each of said support members sequentially from between said opposite edge portions and;

removing each said support member from said second work station in a direction transverse to the path of said strip feed and transferring each said support member to a third work station for attachment to a cutting edge portion of a razor blade.

2. A method of manufacturing as set forth in claim 1 which further includes the step of forming a plurality of registration openings in the opposite edge portions of said strip of sheet material during the forming of said support members.

3. A method of manufacturing as set forth in claim 2 wherein said feed means comprises a movable sprocket for engaging said registration openings and feeding the strip of material into said second work station.

4. A method of manufacturing as set forth in claim 3 which further includes the step of aligning said strip of material at said second work station prior to severing each said support member.

5. A method of manufacturing as set forth in claim 3 which further includes the step of aligning said strip of material at said second work station prior to severing each said support member by providing a plurality of elongated alignment members for extending through said registration openings.

6. A method of manufacturing as set forth in claim 2 which further includes the step of aligning said strip of material at said second work station prior to severing each said support member by providing a plurality of elongated alignment members for extending through said registration openings.

7. A method of manufacturing as set forth in claim 1 which further includes the step of aligning said strip of material at said second work station prior to severing each said support member.

8. A method of manufacturing as set forth in claim 1 wherein a strip of barrier material is provided to one surface of said strip of sheet material after forming of said plurality of discrete support members and prior to rewinding said coiled strip at said first work station.

9. A method of manufacturing as set forth in claim 1 wherein said discrete support members are substantially L-shaped in cross-section.

* * * * *